US007429118B1

(12) United States Patent
Borowiak

(10) Patent No.: US 7,429,118 B1
(45) Date of Patent: Sep. 30, 2008

(54) LIGHT WAY

(76) Inventor: Nathan Borowiak, 1783 Fawn Cir., Pacific, MO (US) 63069

( * ) Notice: Subject to any disclaimer, the term of this patent is extended or adjusted under 35 U.S.C. 154(b) by 0 days.

(21) Appl. No.: 11/784,286

(22) Filed: Apr. 6, 2007

(51) Int. Cl.
*F21L 4/00* (2006.01)
*F21S 8/08* (2006.01)

(52) U.S. Cl. ..... 362/194; 362/183; 362/184; 362/641; 362/253; 362/410

(58) Field of Classification Search ..... 362/183, 362/184, 194, 641, 642, 644, 240, 251, 253, 362/260, 276, 410, 407, 802, 800
See application file for complete search history.

(56) References Cited

U.S. PATENT DOCUMENTS 2,668,228 A 2/1954 Levinson
3,976,986 A 8/1976 Zabroski
D243,473 S 2/1977 Freeman
4,096,553 A 6/1978 Roche
4,144,462 A 3/1979 Sieron et al.
4,410,835 A 10/1983 Zabroski
2005/0157482 A1 7/2005 Hsu
2005/0258954 A1 * 11/2005 Ruskin ..... 340/527
2006/0238136 A1 * 10/2006 Johnson, III et al. ..... 315/185 R

* cited by examiner

*Primary Examiner*—Jocob Choi

(57) ABSTRACT

The invention is a fluorescent lamp with integrated night light, removable power cord, and battery backup that provides emergency lighting during A/C power failure. The battery backup consists of a removable tray that stores a plurality of batteries. The fluorescent lamp is designed to appear like a traditional table lamp. A plurality of switches adorns the lower base of the lamp and provides flexibility to the various functions.

1 Claim, 3 Drawing Sheets

LIGHT WAY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of lamps, night lamps, and lamps with battery pack-ups.

B. Prior Art

The Roche patent (U.S. Pat. No. 4,096,553) discloses an emergency table lamp having batteries for supplying power during loss of A/C power. However, the emergency table lamp disclosed under the Roche patent does not have a night light incorporated into the design of the lamp.

The Levinson et al. patent (U.S. Pat. No. 2,668,228) discloses a plug-in lamp having batteries for use during power source failures. However, the plug-in lamp disclosed under the Levinson patent does not have a night light incorporated into the design of the lamp.

The Zabroski patent (U.S. Pat. No. 4,410,835) discloses an emergency lamp having solid state switching, batteries and removable power cord. However, the emergency lamp disclosed under the Zabroski patent does not have a night light incorporated into the design of the lamp.

The Zabroski patent (U.S. Pat. No. 3,976,986) discloses an emergency lamp having standard plug connectivity and batteries. During power loss, the device automatically turns on to provide emergency lighting. However, the emergency lamp disclosed under the Zabroski patent does not resemble a table lamp with a night light.

The Sieron et al. patent (U.S. Pat. No. 4,144,462) discloses an emergency fluorescent lighting assembly having batteries to supply source of power during utility A/C power failure. However, the lighting assembly disclosed under the Sieron patent does not resemble a lamp, and does not include a night light into the lighting assembly.

The Hsu patent application Publication (U.S. Pub. No. 2005/0157482) discloses a non-interruption light source comprising a base and lamp shade that switches to battery power operation when primary power is not detected. However, the non-interruption light source disclosed under the Hsu Publication does not have a night light incorporated into the design of the lamp.

The Freeman patent (U.S. Pat. No. Des. 243,473) illustrates a design for a fluorescent table lamp, which does not illustrate a backup battery supply and/or a night light integrated into the design of the lamp.

In light of the above discussed prior art there is a need for a table lamp that has a night light incorporated into the design, and a backup battery supply that operates the lamp to provide emergency lighting during a power outage.

BRIEF SUMMARY OF THE INVENTION

The invention is a fluorescent lamp with integrated night light, removable power cord, and battery backup that provides emergency lighting during A/C power failure. The battery backup consists of a removable tray that stores a plurality of batteries. The fluorescent lamp is designed to appear like a traditional table lamp. A plurality of switches adorns the lower base of the lamp and provides flexibility to the various functions.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
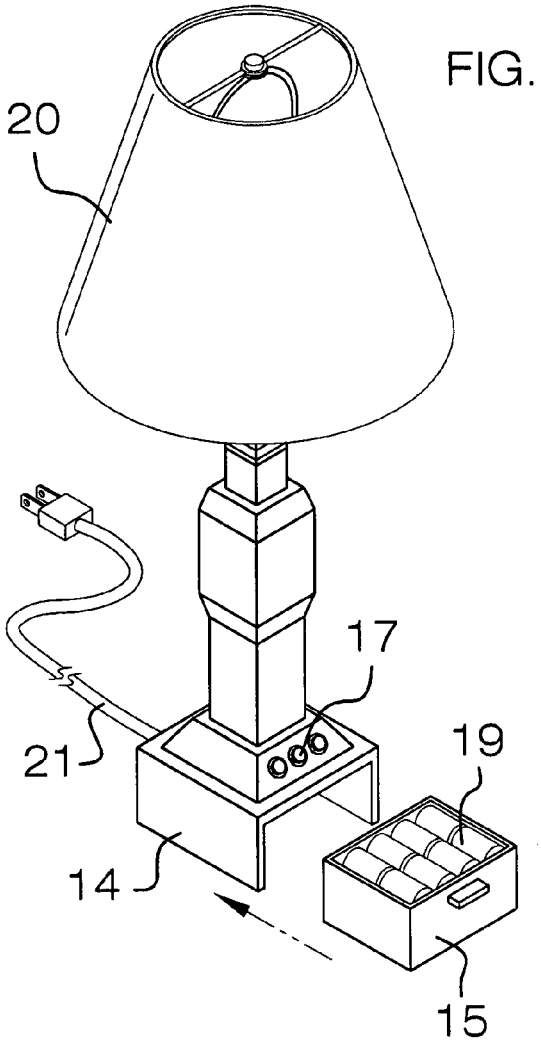
FIG. 1 illustrates an isometric view of the invention.
Figure 2:
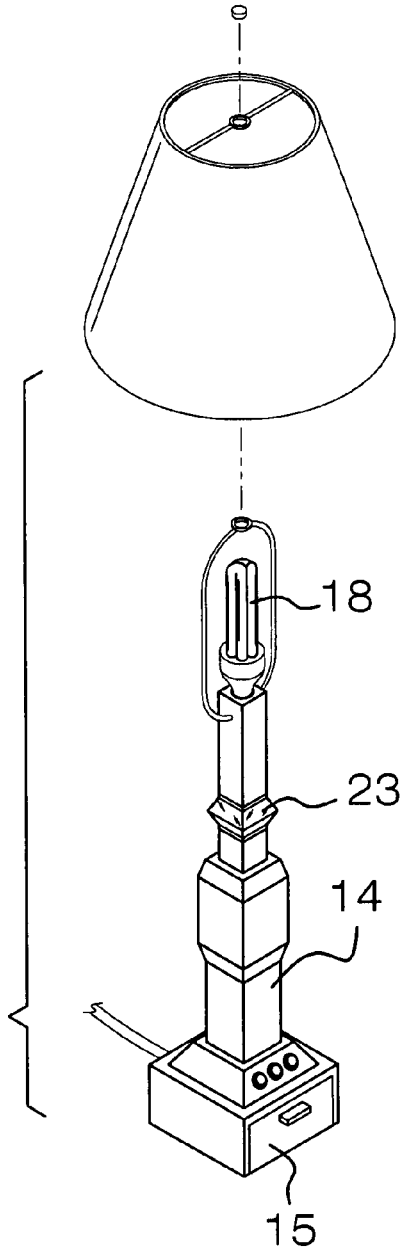
FIG. 2 illustrates an exploded view of the invention.
Figure 3:
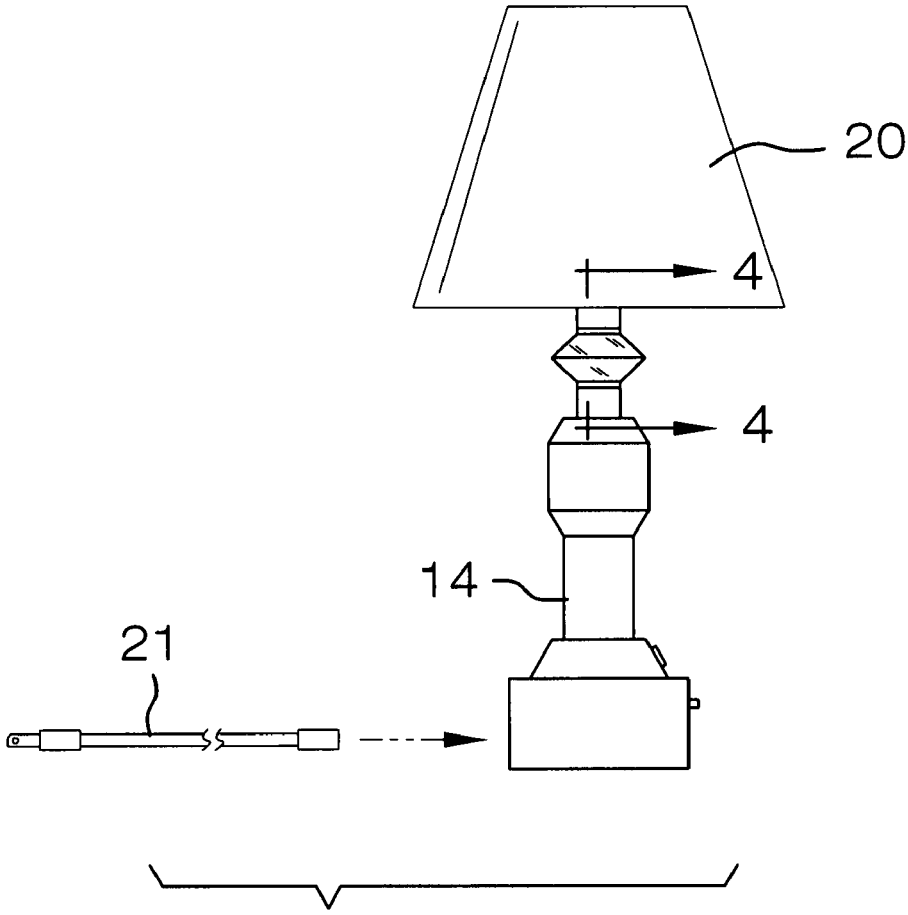
FIG. 3 illustrates a left side view of the invention.
Figure 4:
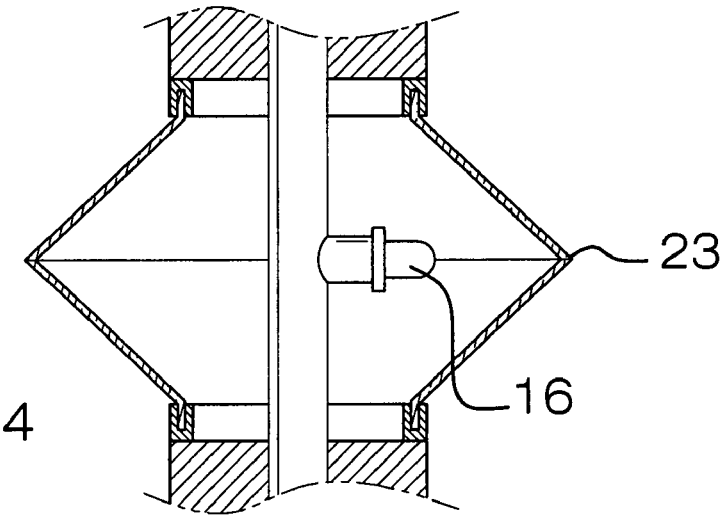
FIG. 4 illustrates a cross-sectional view of the invention along line 4-4.
Figure 5:
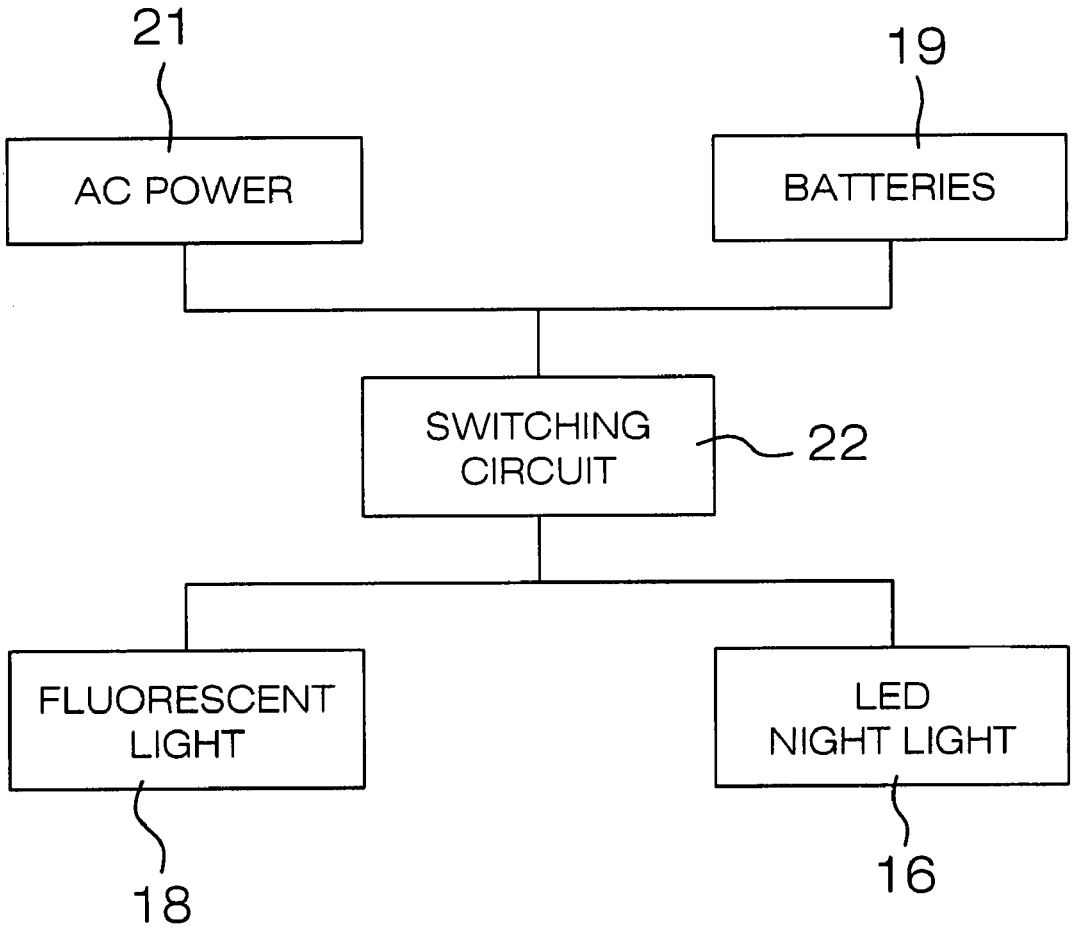
FIG. 5 illustrates a diagram of the electronic circuits.

Detailed reference will now be made to the preferred embodiments of the present invention, examples of which are illustrated in FIGS. 1-5. The invention 10 comprises a lamp base 14 that contains a battery compartment 15, an integrated led light 16, a plurality of control switches 17, and a fluorescent light 18. The battery compartment 15 houses a plurality of batteries 19 that provide power to either the integrated led light 16 or the fluorescent light 18 when during A/C power failure. A lamp shape 20 is securely fastened to the top of the lamp base 14. A removable power cord 21 connects to the rear of the lamp base 14 and provides A/C power.

Located within the lamp base 14 is a switching circuit 22 that connects to the fluorescent light 19 as well as the integrated led night light 17. The switching circuit 22 receives either AC power or DC power from the removable power cord 21 or the batteries 19. The switching circuit 22 is operated by the control switches 17, which turn on/off the fluorescent light 18 and/or the integrated led light 16.

Located on the lamp base 14 is a translucent material that diffuses light from the integrated led light 16, and produces the night light 23.

The invention claimed is:

1. A fluorescent lamp comprising:

(a) a lamp base;

wherein a battery compartment fits inside of the lamp base;

wherein an integrated LED light source fits inside a predetermined space on the lamp base, which contains a translucent material immediately surrounding the integrated LED light that when illuminated casts a night light-like glow;

wherein a removable power cord connects to the lamp base;

wherein a fluorescent light is attached to the top of the lamp base;

wherein a lamp shade fits over the fluorescent lamp and securely attaches to the lamp base;

wherein a plurality of control switches adorn the lamp base, immediately above the battery compartment, and turn on or off either the fluorescent light or the night light;

wherein a battery pack stores a plurality of batteries and slides into the bottom of the lamp base; and wherein a switching circuit connects to the battery pack as well as the removable power cord and continuously supplies power to either the night light or the fluorescent light.

* * * * *